United States Patent [19]

Ratchford

[11] Patent Number: 4,695,109

[45] Date of Patent: Sep. 22, 1987

[54] QUICK RELEASE CONNECTOR

[75] Inventor: Lloyd G. Ratchford, Oneonta, N.Y.

[73] Assignee: Allied Corporation, Morris Township, Morris County, N.J.

[21] Appl. No.: 902,240

[22] Filed: Aug. 28, 1986

[51] Int. Cl.[4] ..... H01R 13/62

[52] U.S. Cl. ..... 439/155; 439/317

[58] Field of Search ..... 339/45, 75 R, 75 M, 339/75 P, 91 R, 91 B, 46, 88, 89, DIG. 2

[56] References Cited

U.S. PATENT DOCUMENTS

| | | | |
|---|---|---|---|
| 3,328,743 | 6/1967 | Acord | 339/45 |
| 3,430,184 | 2/1969 | Acord | 339/45 |
| 3,452,316 | 6/1969 | Panek et al. | 339/45 |
| 3,458,850 | 7/1969 | Causher | 339/45 |
| 3,509,515 | 4/1970 | Acord | 339/45 |
| 3,594,694 | 7/1971 | Clark | 339/45 M |
| 3,609,632 | 9/1971 | Vetter | 339/14 |
| 4,279,458 | 7/1981 | Knapp | 339/45 M |

OTHER PUBLICATIONS

Ser. No. 281,150 (Schildkraut et al), Releasing Electrical Connector.

Ser. No. 453,088, (Ratchford et al), A Moisture Seal for an Electrical Connector.

Ser.No. 835,019 (Frear), Releasing Electrical Connector.

*Primary Examiner*—Gil Weidenfeld

*Assistant Examiner*—David Pirlot

*Attorney, Agent, or Firm*—C. D. Lacina; R. H. Criss

[57] ABSTRACT

A quick release, two part electrical connector assembly immediately responsive to an external axial release force transmitted thereto without interfering with manual uncoupling rotation seats the foot (58) from each of three locking fingers (56) against a bayonet pin (24) from the mated receptacle, each finger extending longitudinally from a locking ring (50) on the plug and adapted to be pulled outwardly of a coupling ring (30) as a result of the bayonet pins transmitting releasing forces to the feet. The locking ring is completely enclosed within the coupling ring and a coil spring (46) is disposed in an annular cavity (70) formed between the rings to resist forward axial movement of the locking ring relative to the plug part. A waved washer (28) seats against the plug flange (14) to bias the locking ring axially rearward.

7 Claims, 5 Drawing Figures

QUICK RELEASE CONNECTOR

This invention relates to a quick release connector.

A two part electrical connector assembly comprises a plug and a receptacle part each configured to mate with one another and each including electrical contacts effective to engage with one another, and a coupling ring assembly of the bayonet-type rotatably captivated to the plug for coupling the parts together. Some applications require that the connector parts be releasable either by manual rotation of the coupling ring assembly or upon application of a predetermined external rearward axial force placed on the connector parts.

U.S. Pat. No. 3,328,743 "Quick Disconnect-Electrical" issued June 27, 1967 to Acord relies on fingers extending longitudinally from a locking ring to engage a respective bayonet pin on the receptacle part, the locking ring being captivated on the plug by a rearward ring nut with a coil spring between the nut and ring resisting rearward movement of the ring. The receptacle part does not start its disengagement until the bayonet pins are pushed back by the semicircular grooves into their bayonet grooves as a result of rearward movement of the locking fingers whereupon the fingers clear their blocking of the respective bayonet grooves and the pins can escape therefrom. A quicker release could be achieved if the receptacle pins and the locking fingers simultaneously started forward disengaging movement upon external axial force being placed on the assembly.

According to this invention a quick release arrangement disposes bias means between the coupling ring and and the locking ring for resisting forward axial movement of the locking ring relative to the plug part, the locking ring including three locking fingers each extending longitudinally therefrom to a transverse foot, and the coupling ring including three longitudinal grooves each intersected by a pin receiving groove, each foot terminating adjacent to its respective pin receiving groove. Application of an axial force on the coupling ring and receptacle part places a force on the pins causing the receptacle part to pull the locking fingers through the longitudinal groove and the bias means to compress. Upon attainment of a predetermined force, the fingers are pulled outwardly of the coupling ring whereby the feet release the pins and the bias means forces the locking ring and its fingers into its standby condition.

An advantage of such a connector assembly is quick electrical disconnection and provision of a locking ring which is immediately responsive to axial release forces without interfering with manual uncoupling rotation.

A more complete understanding of this invention may be obtained from the detailed description that follows taken with the following drawings.

Figure 1:
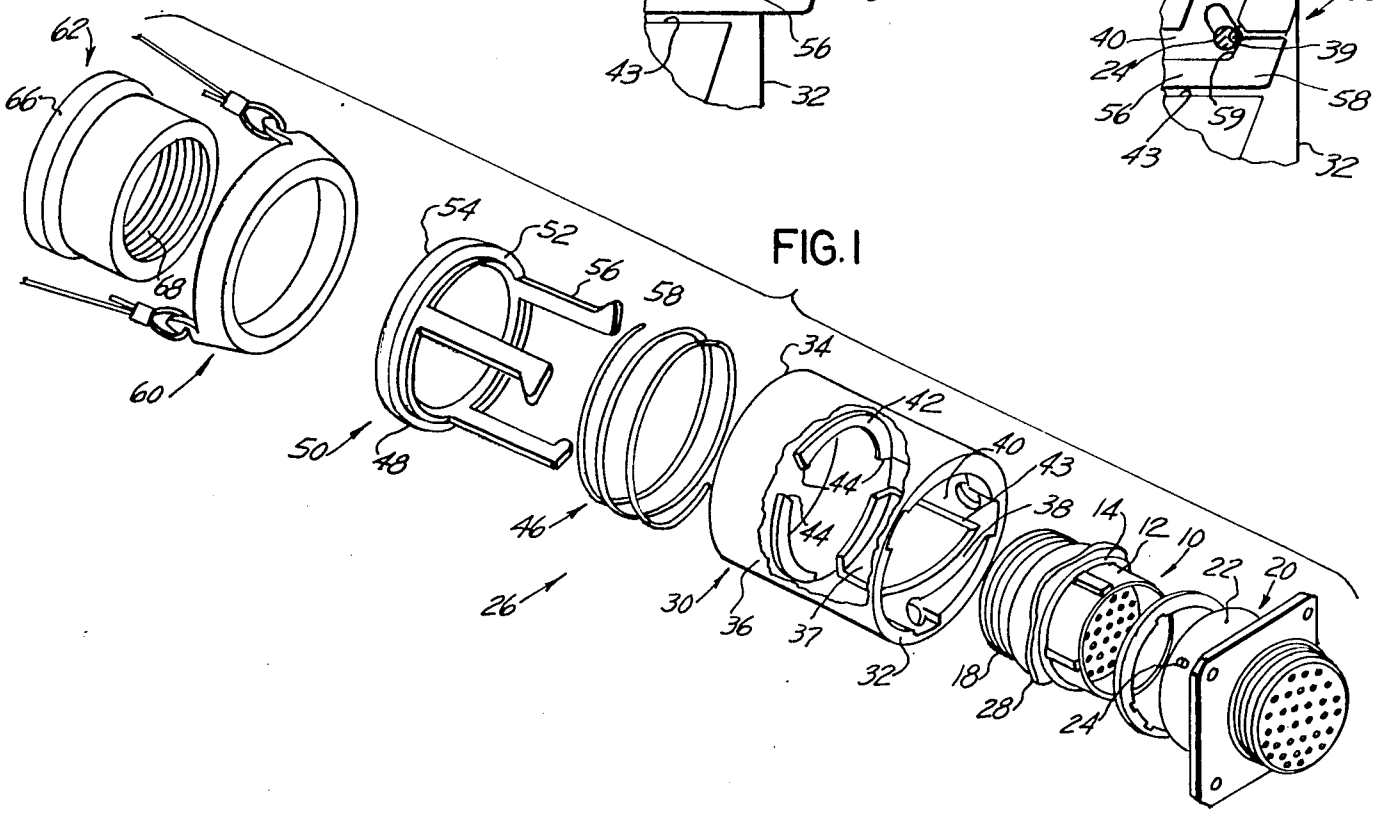
FIG. 1 is an exploded assembly view of a connector assembly positioned for mating with a receptacle part.

Referring now to the drawings, FIG. 1 shows a two part electrical connector assembly comprising a plug and a receptacle part 10,20 each configured to mate with one another and each including electrical contacts (not shown) effective to engage with one another when the connector parts mate. The connector parts include generally cylindrical shells 12,22 each being adapted to mate upon being pulled together along their primary axis.

The plug part 10 has a forward end portion which defines an opening to receive the plug part and includes on its outer periphery one or more radially extending bayonet pins 24. A mounting flange is provided to secure the receptacle to an object, such as a bomb, fuel tank, or some object to which the receptacle is electrically connected and to undergo quick release from.

A coupling ring assembly 26 of the bayonet-type is adapted to be rotatably captivated to the plug for coupling the parts together, the coupling ring assembly including a waved washer 28, a coupling ring 30, a coil spring 46, a locking ring 50, a lanyard ring 60, and a threaded rear adapter 62. The waved washer 28 is adapted to seat against the coupling ring and the rearward face of the flange. The coupling ring 30 includes a cylindrical sleeve 36 having a front face 32, a rear face 34, and a cylindrical inner wall 37, the wall including three spiral grooves 38 each for receiving a respective bayonet pin 24 on the receptacle part, three longitudinal grooves 40 each for receiving a respective locking finger 56, and a set of three partitions 42 each extending radially inward for engaging the waved washer and positioning the coupling ring relative to the plug part. The longitudinal grooves 40 are angularly spaced and extend rearwardly from the front face 32 to the partitions. The spiral grooves 38 initiate on the front face each at an angular location corresponding to one longitudinal groove and spiral axially rearward therefrom to intersect the next adjacent longitudinal groove. Each partition 42 is generally arcuate and planar having flat top and bottom faces and angularly spaced endwalls 44 one and the other endwall terminating at adjacent longitudinal grooves, the endwalls forming longitudinal continuations of the sidewalls 43 defining the respective longitudinal groove.

The locking ring 50 includes a cylindrical body 48 having a forward face 52, a rearward face 54, and a set of three locking fingers 56 each extending perpendicularly from the forward face to terminate in a free end which defines a foot 58 transverse to the finger axis. The outer periphery of the locking ring has a diameter sized to clearance fit into the rearward end portion of the coupling ring so that each locking finger will be received in one respective longitudinal groove thereof and will extend into the forward end portion of the coupling ring so that each respective foot will terminate adjacent to the terminus of one bayonet groove spiralling axially rearward from the front face therof.

The lanyard ring 60 is cylindrical and mounts lanyard ropes whereby to transmit external releasing forces to the connector assembly when mated. The lanyard ring has an inner diameter sized to clearance fit about the rearward end portion of the plug part whereby to face the rearward face 54 of the locking ring 50.

The rear adapter 62 has a cylindrical outer and inner periphery with a collar 66 extending radially from the outer periphery and thread 68 on the inner periphery to engage the external thread 18 on the rearward end portion of the plug part. When threadably fitted to the plug part, the adapter captivates the waved washer 28, the coupling ring 30, the locking ring 50, the coil spring 46 and the lanyard ring 60 on the rearward end portion of the plug part. The radial collar 66 provides an abutment for limiting rearward movement of the lanyard ring when pulled rearwardly by releasing forces.

Figure 2:
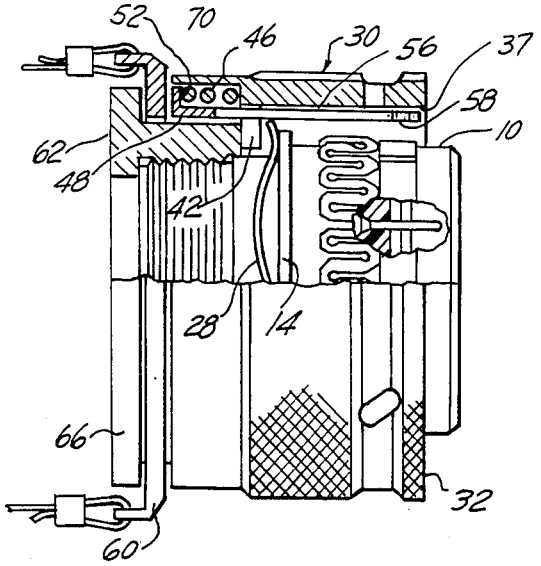
FIG. 2 is a side elevation view partially sectioned to show the unmated connector assembly.

FIG. 2 shows the coupling ring assembly when assembled about the plug part. The waved washer 28 is interposed between the plug flange 14 and the coupling ring partitions 42 and engages both whereby to constantly bias the coupling ring 30 axially rearward relative to the plug part and drive the bottom face of the partitions 42 against the rear adapter 62. An enclosed annular cavity 70 is formed about the outer periphery of the locking ring 50 and the inner wall 37 of the coupling ring and in an axial space between an axial surface forming the partition bottom faces and the forward face 52 of the locking ring 50. The coil spring 46 is fitted into the annular cavity so that the coil encircles both the locking ring and the plug part and opposite axial ends of the coil engage the axial surface forming the bottom surfaces of the partitions and the forward face 52 of the locking ring whereby to constantly bias the front face 32 of the coupling ring axially forward of the feet 58 defining the locking finger free ends. The lanyard ring 60 is loosely rotatably captivated in an annulus formed between the collar 66 on the adapter 62 and both the rearward face 54 and rear face 34, respectively, of the locking and coupling rings 50,30.

Figure 3:
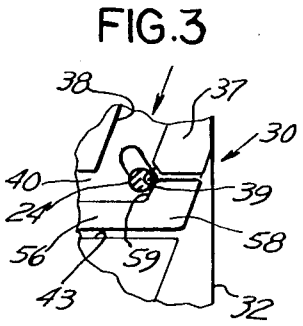
FIG. 3 is a detailed interior view of a mated connector assembly showing a locking finger abutting a receptacle pin.

FIG. 3 shows the inner wall 37 of the coupling ring and a receptacle bayonet pin 24 having been advanced into its bayonet groove 38 on the inner wall 37 of the coupling ring 30. The terminus of each bayonet groove is acutely angled relative to the connector axis so as to define a cam 39 which prevents unwanted reverse (i.e., uncoupling) rotation of the receptacle pin. The waved washer 28 biases the plug part 10 axially forward so that when the bayonet pin reaches the end of its bayonet groove the receptacle will be biased in a reverse axial direction and seat against the cam. Application by the user of an external uncoupling torque (i.e., rotation) will allow manual uncoupling rotation of the connector parts.

Each locking finger 56 when received in its longitudinal groove 40 will seat its foot 58 adjacent to a spiral groove terminus. The foot forms an axially rearward continuation of the spriral groove whereby the pin can enter the longitudinal groove associated with that finger. By being transverse to the finger axis the foot has an end face 59 in abutment with the bayonet pin. The end face 59 defines an abutment surface which the pin will bear against when external releasing forces are placed on the connector pair.

Figure 4:
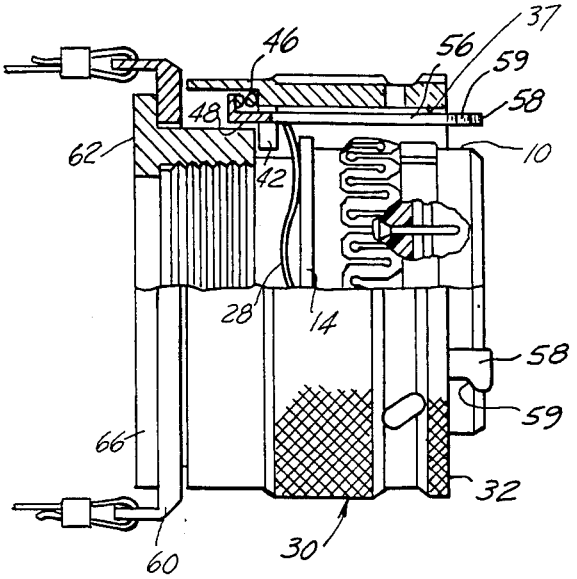
FIG. 4 is similar to FIG. 2 and is a side elevation view partially sectioned of the coupled connector assembly subjected to external force.

FIG. 4 shows the result of an axial force being placed on the lanyard ring and transmitted to the mated connection between the plug and receptacle parts. The bayonet pins will bear against their respective shoulders. If the external force is high enough, the coil spring 46 will be overcome and the locking fingers 56 are pulled axially forward by their receptacle pin whereby each foot 58 is pulled outwardly of the coupling ring (i.e., axially forward of the coupling ring front face 32). At this point the receptacle part is released from the plug part. At such point the coil spring 46 will drive the locking ring rearwardly to retract the locking fingers into the coupling ring.

Figure 5:
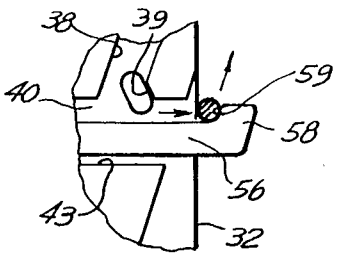
FIG. 5 is similar to FIG. 3 showing the uncoupling as a result of an external force on the receptacle pin and locking finger.

FIG. 5 shows the inner wall of the coupling ring when release is occurring. The free end of the locking finger 56 has been pulled outwardly from the coupling ring by the receptacle pin whereby the receptacle pin is no longer captivated by the coupling ring and the receptacle part is pulled away. At this point, the coil spring will force the locking ring axially rearward and pull the locking fingers back within the coupling ring. The waved washer, which always is biased against the locking ring, will be weaker than the coil spring in order that bayonet pin retention will be accomplished as well as accommodating the predetermined amount of spring release force.

Having described the invention what is claimed is:

1. An electrical connector comprising a plug, a coupling ring surrounding the plug for coupling to a receptacle adapted to releasably mate with the plug, the coupling ring having a bayonet groove spiralling axially rearward from a front face for engaging a bayonet pin extending from the receptacle, and release means for releasing the receptacle from the coupling ring upon the occurrence of an axial force therebetween exceeding a predetermined amount, said release means including a locking ring having a locking finger, first bias means for biasing the locking ring axially rearward relative to the plug, and second bias means for biasing the coupling ring axially forward relative to the locking ring, said second bias means being disposed between said rings.

2. The electrical connector as recited in claim 1 including two or more respective locking fingers and respective bayonet grooves and bayonet pins for connecting the receptacle to the coupling ring.

3. The electrical connector as recited in claim 1 further including a lanyard ring, the lanyard ring being rotatably captivated rearwardly from the locking and coupling rings and adapted to transmit external releasing forces placed on the connector.

4. The electrical connector as recited in claim 1 wherein said coupling ring has a forward and a rearward end portion and a cylindrical inner wall extending between said portions, and a partition defining a shoulder extending radially inward from its inner wall, and said locking ring has a forward face defining a shoulder extending radially outward therefrom, diameters defining the locking ring outer diameter and the coupling ring inner wall being sized such that the locking ring fits completely within the coupling ring rearward end portion, the shoulders defining therebetween an annulus for receiving said second bias means.

5. The electrical connector as recited in claim 4 wherein the inner wall of said forward end portion includes the bayonet groove and a longitudinal groove each extending axially rearward from the front face and intersecting, the partition extending from the inner wall of the coupling ring being angularly discontinuous to define an opening which communicates with the longitudinal groove and passes said locking finger, and the locking finger terminates in a foot adjacent to the bayonet groove terminus for transmitting releasing forces from the bayonet pin.

6. The electrical connector as recited in claim 5 wherein the foot has a transverse axial end face facing rearwardly, the bayonet groove terminates in a cam disposed adjacent to the foot and acutely angled relative to the connector axis, the cam and end face defining a recess for captivating the bayonet pin.

7. The electrical connector as recited in claim 5 wherein the locking finger is of a length sized such that the foot thereof is adapted to be drawn axially forward of the coupling ring as a result of the bayonet pin pulling thereagainst.

* * * * *